United States Patent [19]

Ausnit

[11] Patent Number: 4,691,373

[45] Date of Patent: Sep. 1, 1987

[54] ZIPPER CLOSURE WITH UNITARY ADHESIVE COVER SHEET

[75] Inventor: Steven Ausnit, New York, N.Y.

[73] Assignee: Minigrip, Incorporated, Orangeburg, N.Y.

[21] Appl. No.: 762,765

[22] Filed: Aug. 5, 1985

[51] Int. Cl.[4] ..... B65D 33/16

[52] U.S. Cl. ..... 383/63; 24/576; 156/66; 478/40

[58] Field of Search ..... 383/63, 65, 93, 95; 24/576, 587; 493/213, 214, 237, 381, 382, 220; 156/66, 289; 428/41, 40

[56] References Cited

U.S. PATENT DOCUMENTS

| | | | |
|---|---|---|---|
| Re. 19,128 | 4/1934 | Drew | 493/382 X |
| Re. 28,969 | 9/1976 | Naito | 150/3 |
| 2,382,930 | 8/1945 | Williams | 493/220 |
| 2,483,604 | 10/1949 | Abramson | 493/214 |
| 2,550,000 | 4/1951 | Brady et al. | 383/93 X |
| 2,768,922 | 10/1956 | Klein | 156/66 |
| 2,978,769 | 4/1961 | Harrah | 156/66 X |
| 3,006,793 | 10/1961 | Wheeler, III | 493/381 X |
| 3,785,614 | 1/1974 | Canepa | 428/41 X |
| 3,948,705 | 4/1976 | Ausnit | 156/73.4 |
| 4,341,575 | 7/1982 | Herz | 156/66 |
| 4,354,541 | 10/1982 | Tilman | 383/63 |
| 4,561,109 | 12/1985 | Herrington | 383/65 |

*Primary Examiner*—Stephen Marcus
*Assistant Examiner*—Bryon Gehman
*Attorney, Agent, or Firm*—Hill, Van Santen, Steadman & Simpson

[57] ABSTRACT

Zipper closures for selective attachment along elongated openings in preexisting containers such as bags or cartons to thereby convert such cartons or bags into reclosable containers. The closure for each container comprises a section of a zipper strip assembly having a pair of separable and reclosable strip members provided with respective attachment surfaces on which there is pressure sensitive adhesive. Peelable cover sheet engages the adhesive protectively to permit handling of the zipper closure either as individual lengths or in an indeterminate length from which sections may be severed. The zipper closure is easily applied by peeling the cover sheet and adhesively attaching the attachment surfaces to lips at opposite sides of the elongated opening in the container.

Method and apparatus for making the new and improved zipper closure are also provided.

11 Claims, 14 Drawing Figures

ZIPPER CLOSURE WITH UNITARY ADHESIVE COVER SHEET

The present invention provides a new and improved selectively applicable zipper preferably of the extruded interlocking track variety adapted to be attached to elongate openings in preexisting containers such as bags or cartons which may have been otherwised closed, or even open, but in any event not originally equipped with zipper means. More particularly, the invention relates to zippers which are adapted to be manually secured to bags with elongated openings such as open top bags or bags or cartons which have been slit open for access to contents, thereby converting them into reclosable containers. Improved method and apparatus are also provided.

Heretofore, numerous and varied zipper equipped bag structures, and methods and apparatus for making the bags have been disclosed in issued patents, of which U.S. Pat. Nos. Re. 28,969, 3,948,705 and 4,341,575 are referred to by way of example.

U.S. Pat. No. Re. 28,969 discloses extruded plastic bags which are provided with separable fasteners, i.e. zippers, formed as integral parts of the extrusion. The separable fasteners are of the rib and groove type wherein a generally arrow-shaped rib profile is received in a groove profile, resiliently flexible hooks on the profiles interlocking separably for effecting closure of the bag carrying the same integrally.

U.S. Pat. No. 3,948,705 discloses continuous heat sealing attachment of preformed zipper strips to bag film before fashioning the zipper film into bags. In this patent the zipper strip profiles are disclosed as either of the generally arrow-shaped rib and groove profile or of a multi-hook rib and groove profile arrangement.

U.S. Pat. No. 4,341,575 is referred to for disclosure of adhesively applying preformed zipper strip to preformed bag web or film by adjesive attachment and before the assembly is fashioned into bags. It will be noted that all the web and zipper configurations for bags are disclosed as produced in continuous process in a generally ribbon form and adapted to be separated into bag section fully equipped with zippers.

Of special relevance here is the disclosure in FIG. 10 of U.S. Pat. No. 4,341,575 which relates to the supplying of one part of a zipper strip with pressure sensitive adhesive so that the strip can be applied to a wall of similar surface on which the zipper part serves as a holder for receiving a complementary zipper on any product provided therewith such as a sheet of plans, a curtain element, or the like which can thereby be easily put in place and removed by engagement of the zipper strip on the hung item with the zipper strip on the supporting surface, and it only teaches attaching the surface of one separate sheet to that of another separate sheet. There is no teaching to be derived from this patented disclosure for adapting it to preexisting bags.

A principal object of the present invention is to provide new and improved zipper means for selective attachment to openings in preexisting containers to covert the containers from non-reclosable to reclosable by virtue of the attached zipper.

Another object of the inventions to provide new and improved zipper means which is adapted to be selectively applied to a preexisting container which may have been opened from a sealed state to discharge part of a contents within the container and which by attachment of the zipper means can be converted into a reclosable container wherein the remaining contents will be better preserved by virtue of the attached zipper.

A further object of the invention is to provide a new and improved method of selectively applying a zipper closure to a preexisting container in order to convert the container from a non-reclosable container to a reclosable container.

Still another object of the invention is to provide new and improved method of and apparatus for making zipper adapted to be selectively attached to preexisting containers for rendering the containers reclosable.

To this end, the present invention provides a new and improved zipper closure and a method for selectively attaching the same along an elongated opening in a preexisting container. The closure comprises a zipper strip assembly having a pair of strip members carrying complementary releasably interlocking zipper means either as a continuous strip or a zipper chain or as individual zippers so that the assembly can be handled as a unit, and kept in alignment while being attached and the strip members having respective attachment surfaces on which there is pressure sensitive adhesive. Cover sheet means engaged on the adhesive in protection relation is adapted to be peeled therefrom to expose the adhesive, so that the adhesive on one of the attachment surfaces can be applied to a first lip on the container along the opening in the container, and the adhesive on the other of the attachment surfaces can be applied to a second lip along the opening, and the attachment surfaces pressed onto the lips for adhesion of the zipper members to the lips by means of the adhesive, and thus providing a reclosable closure for the elongated opening in the container.

A desirable attribute of the zipper closure and method thus described reside in that the zipper closure may be selectively applied to a container such as a bag which has a conventional upwardly opening mouth, or to openings formed in any part of a container by slitting an elongate opening therein. Although this zipper closure may be applied to preexisting containers before they are filled, as where a household wishes to convert a non-reclosable bag to become a reclosable bag before inserting some sort of contents therein, sealed containers which have been acquired with contents therein may be converted into reclosable containers after a part of the contents has been removed and it is desired to preserve and protect the remaining contents. For example, discrete comestibles such as beans, rice, raisins, sugar, shredded coconut, and the like, are commonly supplied in sealed packages such as plastic bags or cartons, and after slitting such bags or cartons open for removal of part of the contents, the selectively attachable zipper of the present invention provides a useful means for rendering the opened packages reclosable, and preserving and protecting the contents.

The selectively attachable zipper may be supplied in consumer packets in strip form or in roll form.

New and improved apparatus and method for making the new zipper closure are provided by the present invention.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which.

Figure 1:
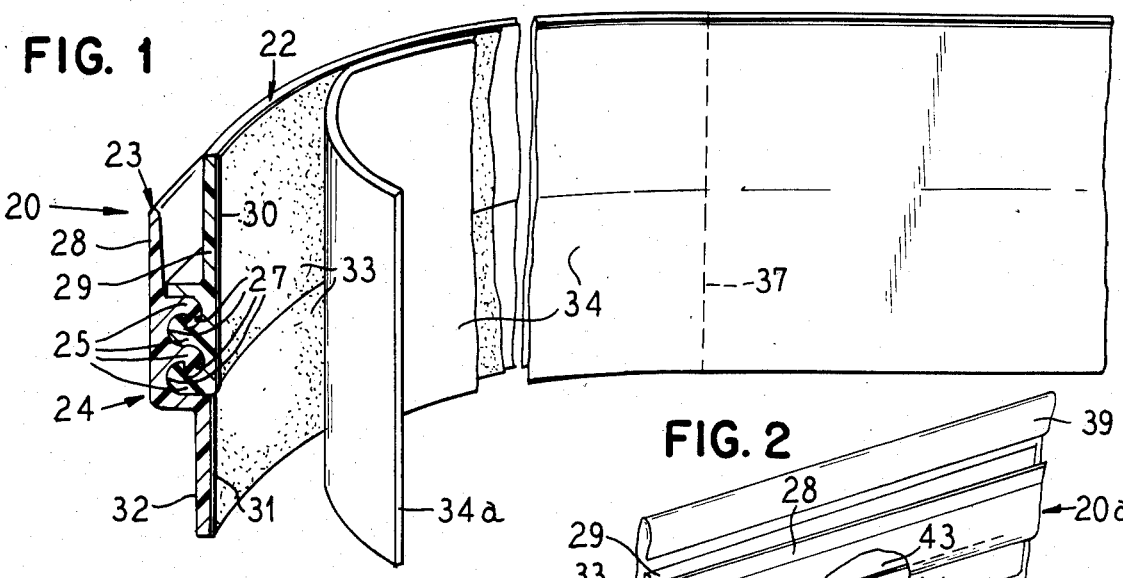
FIG. 1 is a fragmental illustrative view of zipper closure embodying the present invention.
Figure 3:
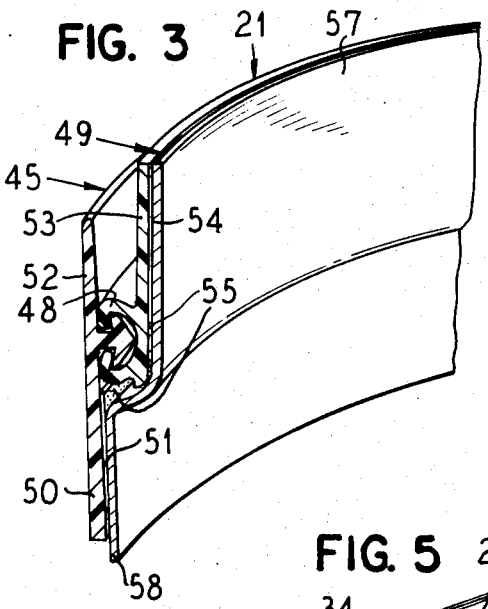
FIG. 3 is a view similar to FIG. 1 but showing a modification.

In the several examples, which will now be more particularly described, the zipper closure structures as such will be recognized as of well known types comprising extruded plastic strips carrying the separable interlockable rib and groove profiles, one form of which is represented in the zipper 20 in FIG. 1 and another form of which is represented in the zipper 21 in FIG. 3.

As shown in FIG. 1, the zipper 20 comprises an assembly having a pair of strip members 22 and 23 carrying complementary releasably interengaged zipper means 24 so that the assembly can be handled as a unit. The zipper means 24 comprises a plurality of parallel, resiliently flexible, complementary rib profiles 25 and intervening complementary grooves 27. The zipper profiles 25 are adapted to be pressed together into interlocked relation and are separable by pulling them apart as by means of separating force digitally applied to a pull flange 28 on the zipper strip member 23 and which confronts a flange 29 extending in the same directional on the zipper strip member 22.

Each of the zipper strip members 22 and 23 has an attachment surface, comprising, respectively, an attachment surface 30 on the back of the flange 29 of the member 22 and which surface may extend also along the back of the zipper profile area of the member 22. On the zipper strip member 23, a respective attachment surface 31 is provided on the back of an attachment flange 32 which extends from the zipper means 24 in the opposite direction from the pull flange 28. It will be observed that the attachment surfaces 30 and 31 in this instance lie substantially coplanar.

Pressure sensitive adhesive 33 on the attachment surfaces 30 and 31 enables the fastener strip assembly 20 to be attached to a container surface, as will be described in greater detail. To protect the adhesive 33 and to permit handling of the zipper assembly 20 without the adhesive 33 catching on any environmental surface until it is intended to apply the zipper closure to a bag, peelable cover sheet means 34 in the form of a ribbon is applied in covering relation to the attachment surfaces 30 and 31 and held in place by the adhesive 33 but is adapted to be peelably stripped therefrom, as indicated at 34*a*. By preference, the sheet 34 is of a width to bridge across the joint between the zipper strips. To facilitate the peeling procedure, starter means are provided on the sheet 34, comprising a projecting margin 35, thereof on at least one of either longitudinal edge of the zipper assembly, herein shown as along the free edge of the flange 32.

It may be noted that while the interlocked zipper profile means 24 serves as a primary connection for permitting handling of the assembled fastener strips 22 and 23 as a unit, the cover sheet 34 serves as a secondary connection for this purpose. Thereby, the fastener strips 22 and 23 are effectively held against inadvertent separation or the longitudinal sliding of one zipper strip member relative to the other during storage and handling.

For houshold use convenience, the zipper strip assembly 20 may be merchandised as individual sections of any preferred length or selection of lengths, or may be provided in a continuous strip of indeterminate length and which may be cut by the user, as by means of a scissors or sharp knife, along transverse lines as indicated at 37 to provide sections of any desired length to fit particular use circumstances, i.e. the length of an elongated opening in a preexisting container to which the zipper strip asembly section is to be applied.

Figure 2:
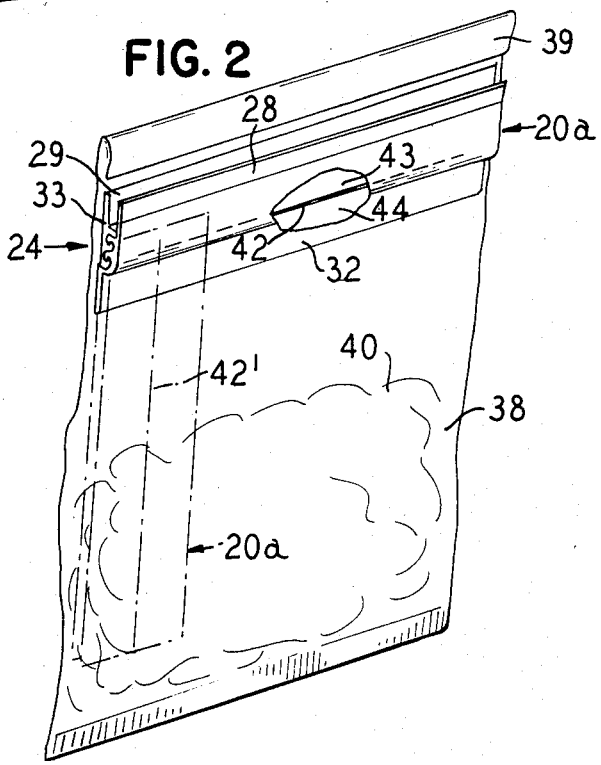
FIG. 2 is a perspective view of a bag to which zipper closure of the type shown in FIG. 1 has been attached along an elongated opening in the form of a slit made in a wall of the bag.

FIG. 2 exemplifies how the zipper strip assembly 20 is adapted to be attached to a preexisting bag 38 which may be formed from any preferred sheet material such as paper or plastic film and permanently sealed along its bottom and side edges. In this instance the top 39 of the bag 38 through which it may have been filled with contents 40 has been closed and adhesively secured or heat sealed, as is conventional for maintaining the contents 40 in a tamper-proof package. Conventionally access into this type of bag has been gained by at least partially cutting or tearing off at least part of the top of the bag and then pouring or otherwise removing all or a part of the content. Where only a part of the contents is removed this leaves the bag vulnerable to inadvertent spillage, and drying out or contamination or access by insects where that may be a consideration.

According to the present invention, these problems attendant upon opened partially filled bags are alleviated by providing a slit 42 at a convenient location in a wall of the bag and then either before or after dispensing part of the contents 40 from the bag attaching the zipper assembly 20, or more particularly a proper length section 20*a* of the zipper assembly 20 to the bag over and along the opening 42. In a preferred arrangement, the slit opening 42 may be shorter than the width of the bag 38, and the length of the zipper assembly section 20*a* longer than the opening and attached to extend beyond each opposite end of the opening.

In attaching the zipper section 20*a* to the bag 38, the cover sheet 34 which has not only retained the zipper strips 22 and 23 in interlocked contiguity for storage, shipment and handling, but has also protectively covered the pressure sensitive adhesive 33, is stripped from the zipper assembly to expose the pressure sensitive adhesive. The zipper assembly is applied to the bag, with one of the adhesively coated attachment surfaces such as the surface 30 applied to a first lip 43 along one side of the opening 42, and the other adhesively coated surface 31 applied to a second lip 44 along and on either side of the opening 42. Then the attachment surfaces are pressed onto the lips for adhesion of the attachment surfaces to the lips. This provides an easily openable and reclosable closure for the elongated opening 42. Beyond the opposite ends of the opening 42, the adhesively attached surfaces of the zipper assembly engage solid areas of the bag.

For opening the bag 38, the closure provided by the zipper assembly section 20*a* is opened by applying digital pull-apart separating force to the zipper flanges 28 and 29 which effects separation of the zipper profiles 25. Of course, the attaching strength of the adhesive attaching the zipper flange to the bag surface has to be greater than the strength or separating force required to separate the zipper closure. The state of development in the adhesive art is such that adhesives to meet whatever requirements can be readily obtained from commercial sources. By pulling the separated zipper strips away from one another, the lips 43 and 44 are separated for pouring or other access through the opening 42 which is expanded by this maneuver. Thereafter, when it is desired to reclose the bag, the zipper strip members are reclosed by pressing them toward one another and snapping the zipper profiles 25 thereof together to their initial coperatively interlocked relation.

By way of proving the feasibility of the invention, certain test were made to determine bond strength and peel strength of the pressure sensitive adhesively attached surfaces of the zippers in contrast to the manipulation strength of the interlockable and releasable zipper means, for example the force or pull strength required to separate the interlocked complementary profiles of the zippers. It was determined that the zipper opening pull strength was between 0.2 and 0.4 pound per linear inch, and this was well below bond strength and peel strength where 3 M #927 acrylic pressure sensitive adhesive was used. To attain a fair range of comparison, sheet material of polyester, oriented polypropylene, cookie package grade paper, and nylon were used as substrates in the tests.

Bond Strength Test

Each of the substrates was tested individually, having the zipper attached at one margin flatwise and in a common plane with the substrate. A relative opposite pull of 12 inches per minute was applied and the results were:

| Substrate | Pounds Per Linear Inch |
|---|---|
| polyester | 7.8 pli (zipper elongated to tear) |
| oriented polypropylene | 9 pli (zipper elongated to tear) |
| paper | to tearing of the paper |
| nylon | 8.6 pli (zipper elongated to tear) |

Peel Strength Test

Right angle flanges of the zipper and substrates were bonded together by means of the pressure sensitive adhesive, with the remainder of the zipper and the substrate extending oppositely in a generally coplaner relation. A pull in the opposite coplaner direction on the zipper and the substrate was applied at a rate of 12 inches per minute. The results were as follows:

| Substrate | Pounds Per Linear Inch To Separation |
|---|---|
| polyester | .9 pli |
| oriented polypropylene | .9 pli |
| paper | 1.2 pli |
| nylon | .8 pli |

Although the peel strengths showed up weaker than the bond strengths, in the normal use of a pressure sensitive adhesive bonded zipper, the peel strength factor does not experience any significant stress.

The substrates tested were of materials available at hand at the time of the testing. The test values can vary based on surface characteristics and slip levels in different material lots. The peel strengths can vary significantly on the paper substrates. Paper strength is governed by the internal bond strength of the paper. An additionally variable would exist if the adhesive coated flange is bonded to a printed paper, due to silicone content which may be present in the ink.

Advantageously, the zipper strip section 20*a* may be applied to any part of a container such as the bag 38 on which it is desirable to provide a reclosable opening. Thus, if instead of having the slit 42 across the top portion of the bag, a slit 42' may be formed elsewhere in the bag such as vertically, if that is more convenient for access into the bag, and the zipper 20 attached along the elongated opening 42' in the same manner and to the same effect as described for its attachment along the opening 42.

Although the zipper strip assembly 21 in FIG. 3 comprises a zipper strip member 45 which has a generally arrow-shaped profile 47 for interlocking with a complementary grooved profile 48 on a zipper strip member 49, various other features of the assembly 21 are substantially the same as already described for the zipper assembly 20. An attachment flange 50 of the zipper strip member 45 has an attachment surface 51, and projects as a pull flange 52 in the opposite direction from the attachment flange 50 on the member 45. An attachment flange 53 on the zipper strip member 49 extends in the same direction as the pull flange 52, and has an attachment surface 54 facing in the same direction as the attachment surface 51. Each of the attachment surfaces 51 and 54 carries pressure sensitive adhesive 55. Peelable cover sheet means 57 in the form of a ribbon of disposable paper material, or the like, is applied in covering relation to the attachment surfaces 51 and 54 and is held in place by the adhesive 55. The cover sheet 57 extends across both of the fastener strips 45 and 49 and thus retains them in properly aligned orientation. Along one edge, the cover sheet 57 may extend beyond the contiguous zipper strip flange and provides a starter flange 58 to facilitate peeling and stripping the sheet 57 when desired. The strip assembly 21 may be used in the same manner as described in connection with the strip assembly 20, in FIG. 2.

Figure 5:
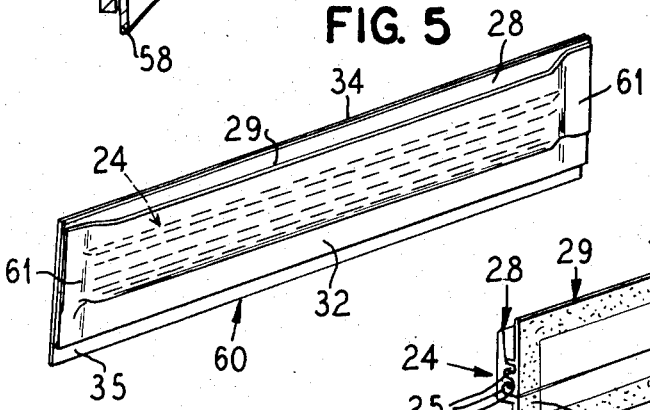
FIG. 5 shows a further modification of the zipper closure with end seals located at predetermined locations.
Figure 4:
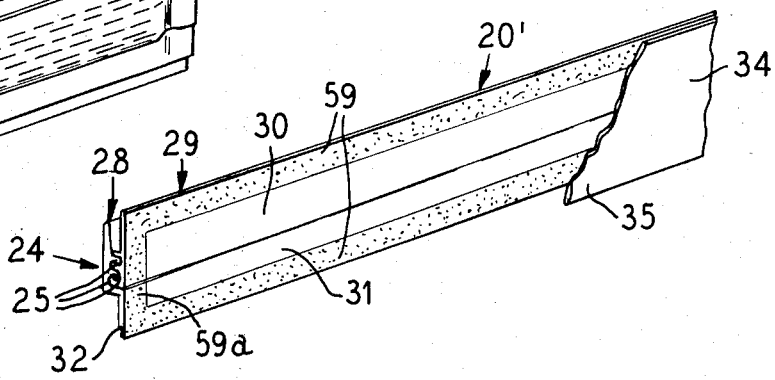
FIG. 4 illustrates a zipper closure similar to FIG. 1 but with a modified arrangement of the pressure sensitive adhesive.

Instead of the pressure sensitive adhesive being applied as an all over coating on the attachment surfaces of the zipper strip members, as shown in FIG. 1, the adhesive may be applied in a partial coating as longitudinal stripes 59 (FIG. 4) of which there may be one as shown on each of the surfaces 30 and 31 or a plurality of parallel stripes. As shown, the adhesive stripes 59 are of substantial width and located along the free margins of the attachment surfaces. Otherwise, the zipper assembly 20' of FIG. 4 is the same as the zipper assembly 20 of FIG. 1, and the same reference numerals have therefore been applied to the assembly 20'. Further, it will be appreciated that the partial adhesive coating may also be applied to the zipper closure assembly 21 (FIG. 3) instead of the all over coating 55 on the attachment surfaces 51 and 54. When only partial adhesive coating 59 has been applied to the zipper strips it is usually preferable to also apply a stripe of adhesive coating 59*a* across each of the ends of the zipper strip assembly so that the assembly is attached to the respective container surface along all four of its edges i.e. side or longitudinal edges as well as ends.

Where absolute assurance is desired against any separation at the ends of a zipper strip section 60 (FIG. 5), whether derived from the zipper strip assembly 20, 20' or 21, the opposite ends of the zipper strip section 60 may be permanently heat sealed as shown at 61 in FIG. 5. This may be effected before or after the zipper strip assembly has been separated into sections. Where the cover sheet 34 is of a material resistant to temperatures greater than the fusion temperature of the plastic material of the zipper strip members, the end seals 61 may be effected after the cover sheet 34 has been applied. On the other hand, the end seals 61 usually will be formed before the adhesive 33 and the cover sheet 34 are applied and then the assembly severed into separate sections or a chain of sections along the area of the seals 61 which may serve as means for gauging the length of the sections 60.

Figure 6:
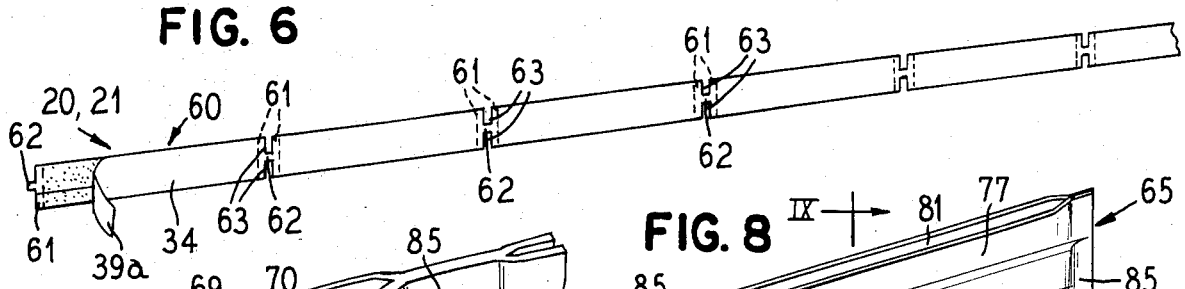
FIG. 6 shows a strip of zipper closures supplied in separable length sections.

For supplying the zipper strip assembly 20 or 21 in a continuous chain length of at least several of the section assemblies 60 and with convenient means for detaching one section from the others needed, the arrangement shown in FIG. 6 is provided. The sections 60 may be provided with permanent end sealing fusions 61, similarly as described in connection with FIG. 5, except that each section is connected in a chain to the contiguous sections by means of a narrow fracturable link 62 substantially narrower than the width of zipper strip assembly and which may be formed by notches 63 at each opposite side of each of the links in the end sealing fusions 61. Thereby, when it is desired to remove one of the sections 60 from the chain of sections, the link 62 connecting it to the next suceeding section in the chain may easily be broken by severance or by a simple longitudinal pull or jerking snapping separating force. This may be done manually by grasping one of the sections in one hand and the next connected section in the other hand and jerking the sections in opposite linear directions, to break the connecting link 62 and separate the sections, or by means of a cutting tool, e.g. scissors. The notches 63 can also provide a peeling means for the cover sheet ribbon 34. Alternately the chain assembly can be created by perforating the end seals, so that one section can be torn apart from the other.

A zipper assembly 65 (FIGS. 7, 8 and 9) is provided embodying the present invention and especially suitable for a reclosable top for a preexisting container such as a bag 67 having a normally open top end 68. In this embodiment the zipper assembly 65 comprises a pair of zipper strip members 69 and 70 carrying separably interengaged zipper means 71 comprising a plurality of parallel, resiliently flexible, complementary rib profiles 72 and intervening complementary grooves 73. In this instance the zipper structure on the strip member 70 may be of the type wherein the ribs and grooves are on a thickened base 74 hingedly attached to a reinforcing rib 75 on the member 70 at the base of an upwardly projecting pull flange 77. Extending downwardly from the rib 75 is a zipper body flange 78 which has a depending attachment terminal flange portion 79 which is generally of coextensive width and length in respect to a depending terminal attachment flange 8 below the zipper structure 71 on the zipper strip member 69. An upwardly extending pull flange 81 on the member 69 desirably projects upwardly to a common or offset (e.g. as in FIG. 1) height with respect to the pull flange 77 of the strip 70. Thereby, when it is desired to separate the zipper structure 71, the flanges 81 and 77 can be manipulated and pulled apart to effect the zipper separation. To reclose the zipper 71 digital pressure applied from opposite sides of the assembly will accomplish the snapping together of the profiles 72 and 73. For attachment of the zipper assembly 65 to the bag 67, the attachment flanges 79 and 80 are provided on their confronting faces with pressure sensitive adhesive 82 which, for storage and handling, is covered by peelable sheet means 83 which desirably has grasping tab extensions 84 projecting beyond the lower edges of the attachment flanges 79 and 80. The sheet means 83 preferably comprises a continuous longitudinally folded ribbon with one half on one of the attachment flanges and the other half on the other attachment flanges.

For convenience of the user, the fastener assembly 65 may be provided in sections similar to the strip assembly sections 60 in FIG. 5 and also may, if preferred, be in a chain arrangement as described in connection with FIG. 6. In any event, the completed assembly is desirably fusion sealed along limited transverse band areas 85 which may extend throughout the width of the pull flanges 69 and 77 if desired, and which positively joins the ends of the zipper structures 71 at each end of each section of the assembly. After the fusion joining, the band area 85 may be separated along a median transverse separation line 87. If desired, of course, the sections of the assembly may be connected together by means of frangible links similarly as the links 62 in FIG. 6.

Figure 7:
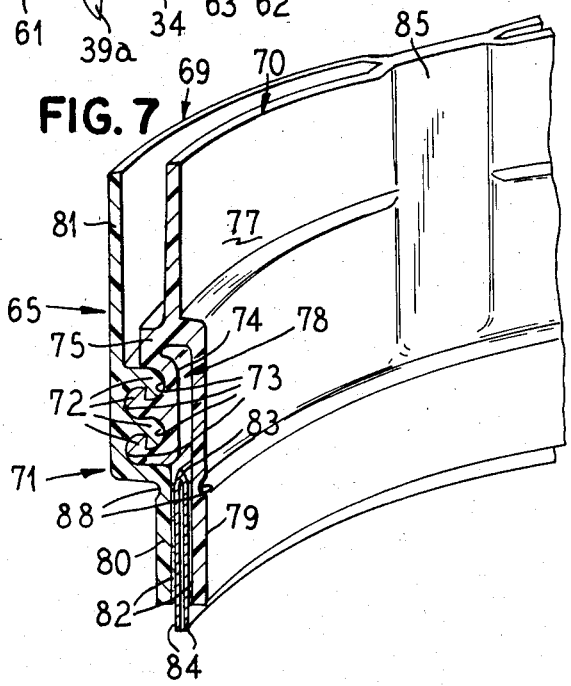
FIG. 7 is a fragmental illustrative view of another modification of the zipper closure.
Figure 8:
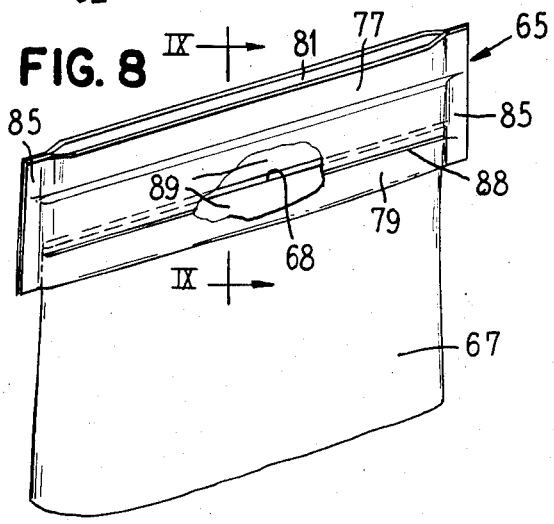
FIG. 8 is a perspective view showing the zipper closure of FIG. 7 applied to a bag.
Figure 9:
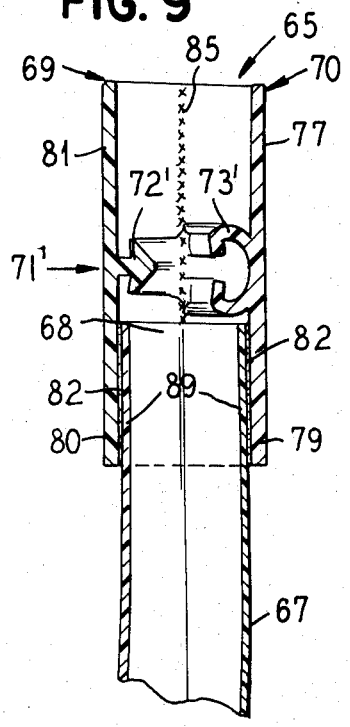
FIG. 9 is an enlarged fragmentary sectional detail view taken substantially along the line IX—IX in FIG. 8, but showing a different zipper construction.

To facilitate mounting attachment of the fastener assembly 65 sections, the attachment flanges 79 and 80 are preferably left free from fusion or other attachment at their opposite ends. That is, although the zipper structure 71 and the pull flanges 69 and 70 may be fusion sealed or welded at 85 at their opposite ends as shown in FIG. 7, the attachment flanges 79 and 80 may be left free to accommodate a wide range of bag styles and sizes to which the zipper sections may be applied. For example, as shown in FIGS. 8 and 9, one of the sections of the assembly 65 may be applied to the bag 67 which is only slightly narrower at its top end than the length of the zipper section. On the other hand in FIG. 10, the zipper section 65 may be substantially longer than the width of the bag. In FIG. 11 the zipper section is shown applied to a bag which is substantially wider than the length of the zipper section.

Figure 10:
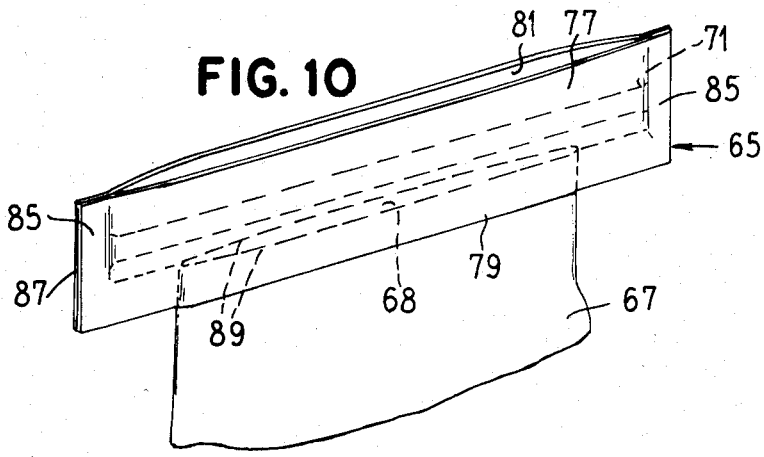
FIG. 10 shows a zipper closure similar to the one in FIG. 8 but of a greater length to accommodate a larger range of bag widths.
Figure 11:
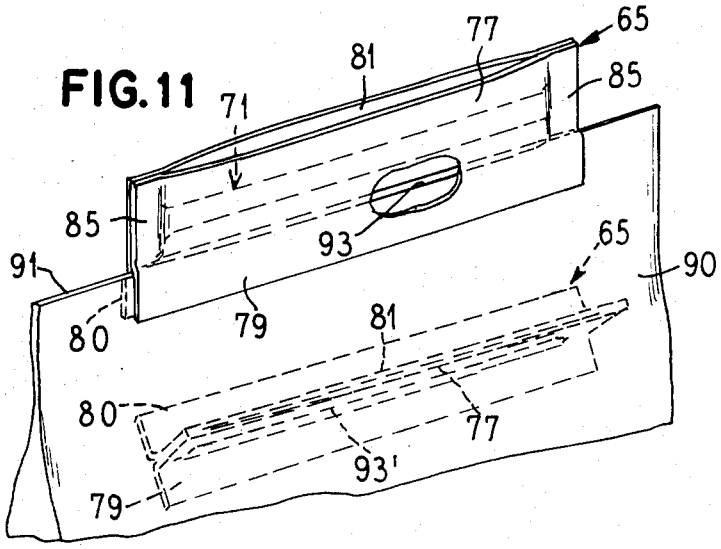
FIG. 11 shows a zipper closure of the type in FIGS. 8 and 10 but applied to a bag having a different kind of top.

In applying the section of zipper 65 to the bag 67 in FIGS. 8 and 10, the attachment flanges 79 and 80 are spread part, as facilitated by narrow hinge thinnings 88 at the upper ends of the attachment flanges, and the cover sheet 83 may be peeled from either or both of the attachment flanges and the zipper section generally centered on the bag top 68. One of the attachment flanges 79 and 80 is then attached to one of the lips 89 along the bag top opening and the other of the attachment flanges upon removal of the cover sheet is adhesively attached to the other of the bag top lips, substantially shown in FIG. 9, which for illustrative purposes shows the zipper opened and the bag top spread open. It will be understood that when the zipper attachment flanges are in position to be attached there will be approximately equal and opposite pressure applied to cause the adhesive 82 to effect adherence of the attachment flanges to the bag top lips 89.

Any portions of the attachment flanges 79 and 80 which extend beyond the opposite sides of bag 67 may be mutually adhesively secured together. This cooperates, with the weldings 85 for assurance against spilling any contents of the bags beyond the ends of the zipper section when pouring from the bag, and assurance against leakage past the ends of the zipper in the closed zipper condition. Such end portion adhesive bonding together of the attachment flanges 79 and 80 will occur regardless of the particular length of the zipper section or the width of the bag as will be apparent from FIGS. 8 and 10.

Although in FIG. 9 the zipper 71' has the arrowhead shape profile 72' engageable in the complementary groove profile 73', the other elements of the zipper assembly are substantially the same as, and therefore indentified by reference numerals common to the form of FIG. 7 and have structural and functional similarity. Either form of the zipper assembly may be employed in any of FIGS. 8, 10 and 11.

In FIG. 11 the section of zipper assembly section 65 is depicted as mounted on a bag 90 which is substantially wider than the length of the zipper section. In this instance the bag 90 has a closed top 91 in which a slit 93 is cut for access to contents, such as for pouring contents from the bag. The zipper section is applied by removing the cover strip 83 from the inside pressure sensitive adhesive carrying surfaces of the attachment flanges 79 and 80, centering the zipper assembly over the access slit 93 with the attachment flanges 79 and 80 straddling the bag top 91, and applying mutual or equal and opposite pressure to the attachment flanges with respect to the bag top 91. Then the zipper profile structure 71 may be opened by manipulation of the pull flanges 77 and 81 for access into the bag. By digitally applied pressure for rejoining of the profiles of the zipper structure 71, the bag can be effectively closed.

Where it is desired to provide an access or pouring opening in the front wall or back wall or side wall of the bag 90 or any other fully closed container, the zipper 65 may be applied to the lip surfaces along a slit 93' formed in any wall of the bag. This is effected by spreading the attachment flanges 79 and 80 apart into a substantially common plane and centering the zipper section over the slit 93' and pressing the adhesive faces of the attachment flanges to the lip surfaces along and adjacent the slit. The pull flanges and separable zipper structures then provide a reclosable pouring funnel which projects from the bag wall. Such funnel function of the zipper section assembly may also be present where the zipper assembly is applied to the upper end of the bag. While the illustrations for attaching the zipper assembly 65 have been limited to flexible bags, the zipper assembly can be attached equally to a cardboard box or other types of containers, where reclosability may be desirable.

Apparatus 95 (FIG. 12) is adapted for making zipper assembly as exemplified in FIGS. 1, 3, 4 or 6. Each of the zipper strips 22, 23, 45, 49 is adapted to be integrally extruded in one piece by the extruder 97. From the extruder the freshly extruded strips are guided as by means of guide rollers 98 through a vat 99 carrying chilling solution 100. Then the formed and chilled strips are guided to and between cooperating pinch rolls 101 which squeeze the profiles of the zipper structure 24, or 47 and 48, as the case may be, into interlocked engagment. The zipper assembly is moved on in a production path as by means of driven cooperative pinch rolls 102 spaced downstream from the guide rolls 101 (which may if desired also be driven). In the span between the pinch rolls 101 and the rolls 102, the adhesive 33, or 55, or 59, or **59*a* is applied as by suitable nozzle means 103** or any other preferred device.

Where the adhesive 33, 55 is applied entirely across the receptive faces of the assembly, the nozzle may extend entirely across the assembly. Where only longitudinal strips 59 of the adhesive are desired, a pair of nozzles, or dual nozzles from a common source may be employed as indicated at 104.

Downstream from the adhesive application, the peelable protective sheet 34, 57 is applied as by being supplied as a continuous ribbon from a suitable source such as a roll (not shown) and then onto the adhesive carrying surfaces and caused to adhere to the surfaces by being pressed against the adhesive surfaces between the pinch rolls 102. Thereafter, the asssembly 20, 20' or 21 may be rolled up in dispensing rolls, or commercial size rolls or cut desired section lengths.

When the apparatus 95 is to be employed for making the zipper strip assembly 20' exemplified in FIG. 4 wherein adhesive is applied not only to the edges of the zipper strips, but also across the ends of predetermined zipper strip lengths, with adhesive on all four edges, an adhesive applicator means 105 is adapted to be operated.

In the form shown the applicator 105 is conveniently located in the span between the rolls 101 and the applicator 103, and applies the pressure sensitive adhesive at specific locations across attachment surfaces of the assembly 20'. In this instance the applicator comprises a carriage 107 guided for movement longitudinally, along the path of movement of the zipper, by means such as guide rods 108 supported in any suitable manner by frame or other fixed structure 109. Reciprocal movement of the carriage 107 longitudinally along the zipper assembly path is adapted to be effected by means of an actuator 110 which may be of the fluid operated hydraulic or pneumatic type. As shown, the carriage 107 is of generally inverted U-shape and supports an adhesive applicator nozzle device 111 which is guided for movement from side-to-side across the zipper assembly by means of guide bars or rails 112. Adhesive in fluent state is delivered to the head of the applicator nozzle device 111 from any suitable source through a flexible conduit 113. Means such as a fluid operated actuator 114 is adapted to drive the nozzle device 111 reciprocably from side-to-side as indicated by directional arrow.

The applicator 105 is adapted to be operated selectively when cross application of adhesive is desired. In such event, the zipper strip assembly may run continuously along the machine path, and the applicator 105 driven in timed relation longitudinally along the path with the selected lengths of the zipper assembly to receive the cross application of adhesive, and the applicator nozzle device 111 reciprocated across the zipper assembly to apply the crosswise adhesive 59*a*. After each crosswise adhesive application, the device 105 is returned to a starting position and when the next crosswise application is to be effected, it follows along downstream with the continuously moving zipper assembly while the transverse adhesive application is being effected by means of the nozzle device 111. There is thus a continuous cyclical operation of the applicator 105.

In addition, the apparatus 95 is desirably equipped with means for effecting the cross seals 61 for the zipper assembly sections 60 of FIG. 5, or the combination connecting links 62 and notches 63 with or without the cross seals 61. For this purpose, a device 115 may be part of the apparatus 95 located, for example, between the pinch rolls 100 and the applicator 105. Alternatively, the device 115 may comprise a simple notching bar 117 which is connected by means of a yoke 18, or the like, to an actuator 119 by which the notching bar is reciprocated relative to an anvil 120 having notching recesses 121 into which notching lugs 122 on the bar 117 are received when notching out the notches 63.

Where it is desired to apply fusion heat to effect the heat seals 61, the bar 117 is provided with suitable heat sealing means according to known practice in this art. Thereby concurrently with cutting the notches 63, the cross heat seal 61 is provided in each stroke of the bar or reciprocating head 117. Where the device 115 is used, it will be appreciated that the apparatus 95 will have to be operated in a stop and go fashion. In other words, the zipper assembly will be advanced by desired zipper section lengths, then the device 115 operated, and the zipper assembly then again advanced, cyclically.

Figures 12, 13, 14:
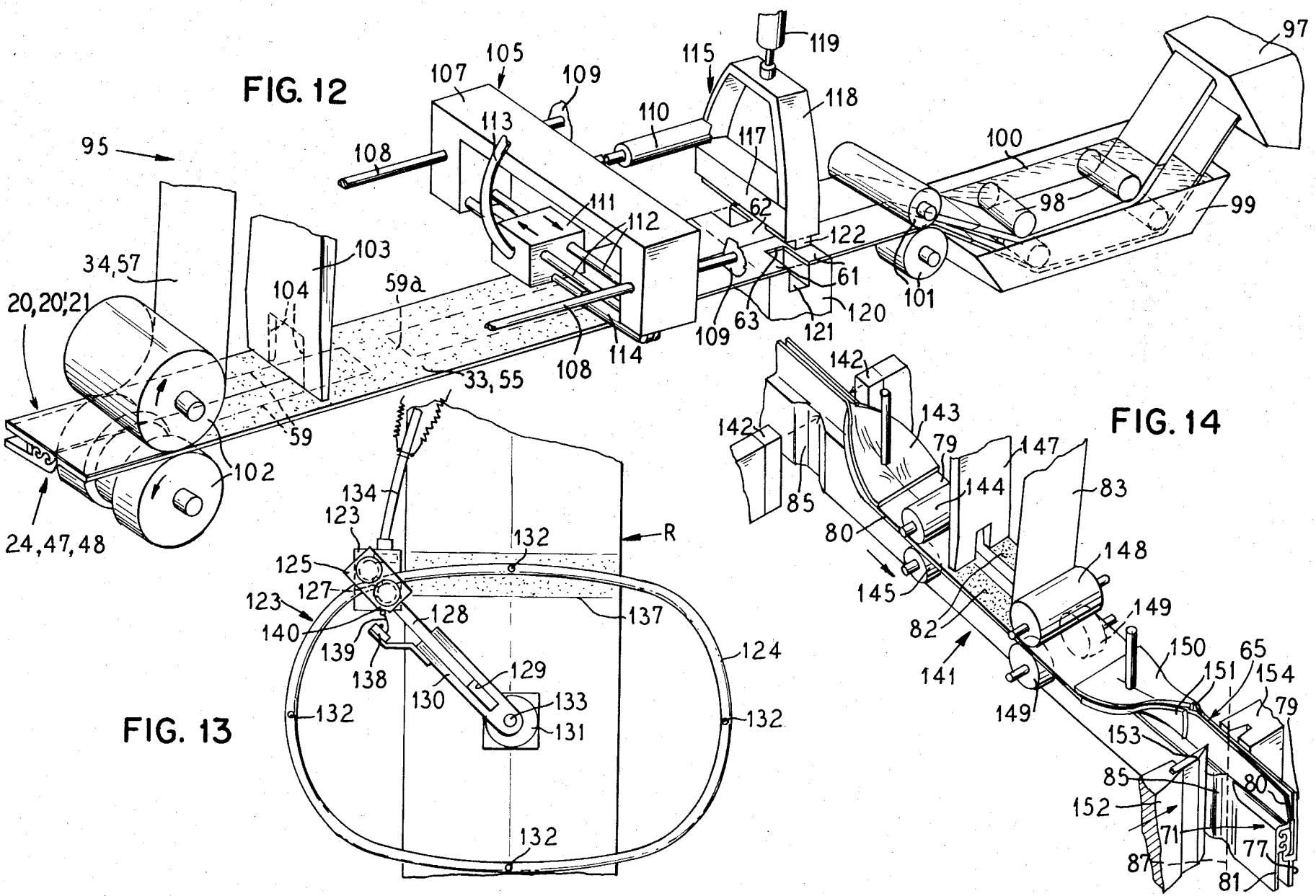
FIG. 12 is a schematic perspective view showing apparatus for producing the zipper closures of FIG. 1 to 5.
FIG. 13 depicts apparatus for applying the adhesive by means of an applicator traveling a loop.
FIG. 14 depicts apparatus for producing the zipper closure of FIG. 7.

If it is desired merely to seal across the zipper assembly, without notching, the recesses 121 and the anvil 120 and the notching lugs 122 will be omitted, as indicated in dash outline in FIG. 12, and the bar 117 will be operated simply as a sealing bar in each operating stroke.

If preferred, the pressure sensitive adhesive may be applied to the attachment surfaces of the ribbon of zipper assembly 20, 20' or 21 in the manner exemplified in FIG. 13, by means of a transverse or shuttle adhesive applicator 123 mounted on an elliptical loop guide track 124 by means of a wheeled tracking head 125 connected to the applicator as by means of a pivot 127. A guide stem 128 fixed to the tracking head 125 extends in reciprocably slidable relation into a guide slot 129 in an actuating arm 130 rotatably driven by a motor 131 on a vertical axis centered in the guide track 124. Suitable overhead support for the track 124 with respect to the traveling zipper assembly ribbon R may be by means of hanger rods 132 or the like attached to overhead supporting structure (not shown). Overhead support for the motor 131 and thereby the arm 130 may be by means of a suspension axle 133. Fluid adhesive is delivered to the applicator 123 by means such as a flexible conduit 134 leading from an adhesive supply source and adapted to follow along with the applicator 123 to which attached. Resiliently flexible means such as springs 135 maintain stabilizing control of the conduit 134 against sagging and the like.

In each rotary cycle in which the applicator 123 is driven by action of the motor 131 and the connecting mechanism, the applicator is controlled to apply one or more transverse bands 137 of adhesive to the attachment surfaces of the zipper ribbon R which faces toward the applicator. The cyclical travel of the applicator 123 along the track 124 is coordinated with the rate of travel of the zipper ribbon to deposit the transverse adhesive bands 137 in a sequence which will result in a covering of the adhesive on the zipper ribbon, at desired locations which correspond to the ends of predetermined length of zipper.

Controlling of the applicator 123 for selectively applying the adhesive bands 137 in one or both of the sweeps of the applicator across the zipper assembly ribbon may be effected by control means including a microswitch 138 having a control lever 139 which rides a cam surface 140 on the track follower head 125. The arrangement is such that in each rotary cycle, because of the generally elliptical shape of the track 124, as the applicator 123 is caused to travel across the zipper ribbon along the large radius sections of the track the switch 138 is closed to activate the applicator 123 for applying successive adhesive bands 137. As the applicator 123 travels the smaller radius sections of the loop provided by the track 124, the switch 138 is opened and the applicator inactivated.

For applying the pressure sensitive adhesive 83 to the attachment surfaces 82 of the attachment flanges 79 and 80 of the zipper assembly 64 in FIG. 7, the apparatus 141 as schematically depicted in FIG. 14 may be employed.

Where required, the production line depicted in FIG. 14 may include a heat sealing fusion device comprising a pair of cooperating fusion bars 142 which act on the zipper structure 71 and pull flanges 77 and 81 of the zipper assembly at suitable longitudinally spaces areas to provide the fusion seals 85. Downstream from the fusion device 142, a plow device 143 separates the attachment flanges 79 and 80 which are then received in generally coplanar relation between rotary pinch rolls comprising a roll 144 and complementary split rolls 145 and, which may be driven for advancing the zipper assembly toward an applicator 147 by which the adhesive 82 is applied to the attachment faces of the flanges 79 and 80. The applicator 147 may be of twin nozzle form so as to apply the pressure sensitive adhesive stripes along the flanges 79 and 80, leaving the longitudinal central portion between the strips free from adhesive so that the adhesive will not enter to the zipper structure 71, and more particularly to the surfaces between the zipper back 74 and the zipper strip body portion 78 (see FIG. 7). Downstream from the applicator 147, the peelable cover sheet 83 is applied by means of a rotary pinch roll 148 cooperating with rotary split pinch rolls 149 supporting the flanges 79 and 80. These pinch rolls may also be driven for advancing the zipper assembly.

Downstream from the pinch rolls 148 and 149, a creasing bar 150 cooperates with a folding plow device 151 for folding the now peelable cover sheet carrying attachment flanges 79 and 80 back upon themselves. Thereby, the attachment flanges 79 and 80 are returned to generally planar alignment with the coflanges 77 and 81 of the zipper assembly 65, and the cover sheet 83 is longitudinally creased along the inner edges of these flanges.

Downstream from the creasing and plow device assembly 150, 151, a cutoff mechanism comprising a reciprocatable bar 152 carrying a shearing knife 153 cooperating with a complementary notched anvil 154 is adapted to separate these zipper strip 65 into sections by cutting the same along the line 87 midway of each successive fusion band 85 (FIGS. 7 and 14). If preferred, of course, the apparatus 141 may be equipped with a perforator for perforating along the line 87 instead of the cutoff device 152, 153, 154. On the other hand, if it is desired to connect the zipper sections by links such as the links 62 to provide a chain by zipper sections, a similar device as the device 115 in FIG. 12 may be employed instead of the simple fusing bars 142.

If preferred, of course, the zipper strip as equipped with the pressure sensitive adhesive 82 and the cover sheet 83 and provided with the fusion seals 85 may be rolled into convenient commerical supply rolls. The completed zipper assembly may then be supplied to an establishment where it may be desired to coordinate separation of the continuous strip assembly into individual sections for combining the sections with a packaged product for the convenience of ultimate users who may wish to convert an otherwise nonreclosable container into a reclosable container by means of the zipper strip assembly sections.

From the foregoing it will be apparent that the present invention provides a new and improved quite versatile means for converting otherwise nonreclosable bag or carton containers into reclosable containers after the containers have been opened for access to their contents. The pressure sensitive adhesive equipped reclosable fastener assembly may be supplied as individual sections or as a continuous ribbon from which sections may be severed as desired. The zipper assemblies lend themselves to direct merchandizing to the ultimate users. On the other hand, the zipper strip assemblies may be supplied to product packagers who may wish to provide individual zipper assembly sections in, or in association with, the packaged product for the convenience of ultimate consumers who may thus convert otherwise nonreclosable containers to zipper equipped reclosable containers.

It will be understood that variations and modifications may be effected without departing from the spirit and scope of the novel concepts of the present invention.

I claim as my invention:

1. Zipper closure for selective attachment along elongated openings in preexisting containers, comprising:

a zipper strip assembly having a pair of contiguous strip members carrying complementary manually interlockable and releasable zipper means which are interlocked so that the assembly can be handled as a unit, said strip members having respective attachment surfaces;

pressure sensitive adhesive on each of said attachment surfaces;

peelable cover sheet means bridging both strip members and engaged on said adhesive in a protecting relationship and adapted to be peelably stripped therefrom to expose said adhesive, so that one of said attachment surfaces can be applied and attached by means of the adhesive thereon to a first lip on a container along an elongated opening therein and the other of said attachment surfaces can be applied and attached by means of the adhesive thereon to a second lip along the opening, for adhesion of the attachment surfaces to the lips and thus providing a reclosable closure for the container at said elongated opening;

said peelable cover sheet means being a single unitary structure with one portion engaged on the adhesive on one of the attachment surfaces and another portion engaged on the adhesive on the other of said attachment surfaces so as to bridge between the strip members so that the strip members do not become separated and are retained together as a unit for handling without inadvertent separation of the strip members; and said adhesive having bonding strength and peel strength, with respect to the substrate of the container to which applied, greater than the manipulation strength normally applied for interlocking or releasing the zipper means after effecting attachment of the attachment surfaces to said lips by means of said adhesive.

2. A zipper closure according to claim 1, wherein said attachment surfaces extend in opposite directions in parallel planes.

3. A zipper closure according to claim 1, wherein said attachment surfaces are in confronting relation to one another, and said peelable cover sheet means comprises a ribbon which is longitudinally intermediately folded for said bridging and with one part engaged on one of said attachment surfaces and another part engaged upon the other of said surfaces.

4. A zipper closure according to claim 3, wherein said attachment surfaces are on respective attachment flanges of said zipper strip members, and said flanges having hinge means facilitating hinging manipulation of said attachment flanges.

5. A zipper closure according to claim 1, wherein said zipper strip assembly has transverse seals subdividing the strip assembly into predetermined length sections.

6. A zipper closure according to claim 5, wherein said seals extend throughout the width of the zipper strip assembly.

7. A zipper closure according to claim 5, wherein said zipper strip members have the attachment surfaces on attachment flanges which extend in the same direction from the interlocked zipper means, and said seals extend across said strip members except said attachment flanges.

8. Zipper closure according to claim 1, wherein said zipper strip assembly contains a plurality of zipper closure section lengths and means connecting the section lengths in series and adapted for gauging the length of the sections.

9. Zipper closure according to claim 8, wherein said connecting means comprise fracturable connecting links which are substantially narrower than the width of said zipper strip assembly.

10. A zipper closure according to claim 1, wherein said attachment surfaces are on areas of substantial width on said strip members, and said adhesive covers substantially the full width of said areas.

11. A zipper closure according to claim 1, wherein said attachment surfaces are on areas of substantial width on said strip members, and said adhesive comprises stripes of adhesive which are substantially narrower than said areas.

* * * * *